US009950549B2

(12) United States Patent
Kanungo et al.

(10) Patent No.: US 9,950,549 B2
(45) Date of Patent: Apr. 24, 2018

(54) IMAGING PLATE MULTI-LAYER BLANKET

(71) Applicant: XEROX CORPORATION, Norwalk, CT (US)

(72) Inventors: Mandakini Kanungo, Penfield, NY (US); Chenyu Lin, Potstdam, NY (US); Kevin H. Taft, Williamson, NY (US); Yu Qi, Penfield, NY (US); Santokh S. Badesha, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/167,353

(22) Filed: May 27, 2016

(65) Prior Publication Data

US 2017/0341452 A1 Nov. 30, 2017

(51) Int. Cl.

| | |
|---|---|
| ***B41N 10/04*** | (2006.01) |
| ***B41F 3/30*** | (2006.01) |
| ***B41N 3/00*** | (2006.01) |
| ***B41J 2/005*** | (2006.01) |
| ***B41M 1/06*** | (2006.01) |
| ***B41N 10/00*** | (2006.01) |

(52) U.S. Cl.

CPC ..... *B41N 10/04* (2013.01); *B41F 3/30* (2013.01); *B41J 2/0057* (2013.01); *B41M 1/06* (2013.01); *B41N 3/00* (2013.01); *B41N 10/00* (2013.01)

(58) Field of Classification Search

CPC ..... B41N 10/04; B41N 3/00
USPC ..... 428/909
See application file for complete search history.

(56) References Cited

U.S. PATENT DOCUMENTS

| | | | | |
|---|---|---|---|---|
| 5,538,782 | A * | 7/1996 | Tomono | B41N 10/02 428/304.4 |
| 7,238,257 | B2 * | 7/2007 | Risquez | B41N 10/02 101/375 |
| 2012/0103212 | A1 | 5/2012 | Stowe et al. | |
| 2014/0060358 | A1 * | 3/2014 | Hsieh | B41N 3/08 101/450.1 |
| 2014/0060362 | A1 * | 3/2014 | Kanungo | B41F 7/00 101/450.1 |
| 2014/0255610 | A1 * | 9/2014 | Sambhy | C09D 183/08 427/387 |

* cited by examiner

*Primary Examiner* — Alison L Hindenlang
*Assistant Examiner* — Michael Robinson
(74) *Attorney, Agent, or Firm* — Caesar Rivise, PC

(57) ABSTRACT

An apparatus and method of manufacturing a multiplayer image blanket with a platinum catalyzed fluorosilicone topcoat for a variable data lithography printing system. The blanket consists of multiple layers that may be: (A) a commercial carcass having a Sulphur free rubber outer layer, a suitable primer layer for improving the inter-layer adhesion, and the platinum catalyzed fluorosilicone topcoat; or (B) seamless polyimide substrate coated with a platinum cured silicone, a primer layer, and the fluorosilicone topcoat.

10 Claims, 2 Drawing Sheets

IMAGING PLATE MULTI-LAYER BLANKET

FIELD OF DISCLOSURE

The disclosure relates to marking and printing systems, and more specifically to an image transfer element of such a system having a controlled surface topography.

BACKGROUND OF THE INVENTION

Offset lithography is a common method of printing today. (For the purposes hereof, the terms "printing" and "marking" are interchangeable.) In a typical lithographic process, an image transfer element or imaging plate, which may be a flat plate-like structure, the surface of a cylinder, or belt, etc., is configured to have "image regions" formed of hydrophobic and oleophilic material, and "non-image regions" formed of a hydrophilic material. The image regions are regions corresponding to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based fluid, commonly referred to as a fountain solution or dampening fluid (typically consisting of water and a small amount of alcohol as well as other additives and/or surfactants to, for example, reduce surface tension). The hydrophobic regions repel fountain solution and accept ink, whereas the fountain solution formed over the hydrophilic regions forms a fluid "release layer" for rejecting ink. Therefore, the hydrophilic regions of the imaging plate correspond to unprinted areas, or "non-image areas", of the final print.

The ink may be transferred directly to a substrate, such as paper, or may be applied to an intermediate surface, such as an offset (or blanket) cylinder in an offset printing system. In the latter case, the offset cylinder is covered with a conformable coating or sleeve with a surface that can conform to the texture of the substrate, which may have surface peak-to-valley depth somewhat greater than the surface peak-to-valley depth of the imaging blanket. Sufficient pressure is used to transfer the image from the blanket or offset cylinder to the substrate.

The above-described lithographic and offset printing techniques utilize plates which are permanently patterned with the image to be printed (or its negative), and are therefore useful only when printing a large number of copies of the same image (long print runs), such as magazines, newspapers, and the like. These methods do not permit printing a different pattern from one page to the next (referred to herein as variable printing) without removing and replacing the print cylinder and/or the imaging plate (i.e., the technique cannot accommodate true high speed variable printing wherein the image changes from impression to impression, for example, as in the case of digital printing systems).

Efforts have been made to create lithographic and offset printing systems for variable data. One example is disclosed in U.S. Patent Application Publication No. 2012/0103212 A1 (the '212 Publication) published May 3, 2012, and based on U.S. patent application Ser. No. 13/095,714, which is commonly assigned, and the disclosure of which is hereby incorporated by reference herein in its entirety, in which an intense energy source such as a laser is used to pattern-wise evaporate a fountain solution. The '212 publication discloses a family of variable data lithography devices that use a structure to perform both the functions of a traditional imaging plate and of a traditional blanket to retain a patterned fountain solution of dampening fluid for inking, and to delivering that ink pattern to a substrate. A blanket performing both of these functions is referred to herein as an imaging blanket. The imaging blanket retains a fountain solution, requiring that its surface have a selected texture. Texturing of imaging blankets presents opportunities for optimization.

Furthermore, the imaging blanket must be thermally absorptive in order to enable rapid evaporation of the fountain solution during patterning. One aspect of thermal absorptivity is the composition of the imaging blanket. Configuring the composition of the imaging blanket to balance thermal absorptivity together with other requirements of the blanket such as texture, durability, affinity to water and oil, and so on presents further opportunities for optimization.

Fluoroelastomers and fluoropolymers have been used in a variety of printing systems over the years. For example, fluoroelastomers have been used to form the reimaginable surface in variable data lithography systems. Fluoroelastomers are attractive for their thermal and chemical properties, as well as their release properties when used with specific toner and printing ink materials. Accordingly, there is a need for new fluoroelastomers compositions that enable development of new systems for offset printing and/or variable data lithography, as well as for other printing applications. This need includes new configurations, including multilayer imaging blankets that provide the ability to fine tune the conformance of the imaging blanket for optimum transfer condition of ink to media.

BRIEF SUMMARY OF THE INVENTION

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a multilayer imaging blanket for a variable data lithography printing system, including a multilayer base, a platinum catalyzed fluorosilicone surface (or topcoat) layer, and a primer layer. The platinum catalyzed fluorosilicone surface layer is coated about the multilayer base and includes carbon black, a silica, a crosslinker, and a solvent. The primer layer is between the multilayer base and the fluorosilicone surface layer for improving interlayer adhesion between the multilayer base and the fluorosilicone surface layer.

The exemplary embodiments may include a method of manufacturing a multilayer imaging blanket for a variable data lithography printing system. By example, the method includes applying a multilayer base composition into a mold structure, applying a primer layer over the multilayer base, coating a platinum catalyzed fluorosilicone surface layer about the primer layer, the platinum catalyzed fluorosilicone surface layer including carbon black, a silica, a crosslinker, and a solvent, the primer layer improving interlayer adhesion between the multilayer base and the fluorosilicone surface layer, and curing the platinum catalyzed fluorosilicone surface layer.

According to aspects illustrated herein, a variable data lithography system useful in printing has a multilayer imaging blanket, a fountain solution subsystem, a patterning subsystem, an inking subsystem, and an image transfer subsystem. The multilayer imaging blanket includes a multilayer base, a platinum catalyzed fluorosilicone surface layer, and a primer layer. The platinum catalyzed fluorosilicone surface layer is coated about the multilayer base and includes carbon black, a silica, a crosslinker, and a solvent. The primer layer is between the multilayer base and the fluorosilicone surface layer for improving interlayer adhesion between the multilayer base and the fluorosilicone surface layer. The fountain solution subsystem is configured for applying a layer of fountain solution to the multilayer imaging blanket. The patterning subsystem is configured for selectively removing portions of the fountain solution layer so as to produce a latent image in the fountain solution. The inking subsystem is configured for applying ink over the imaging blanket such that said ink selectively occupies regions of the imaging blanket where fountain solution was removed by the patterning subsystem to thereby produce an inked latent image. The image transfer subsystem is configured for transferring the inked latent image to a substrate.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION OF THE INVENTION

Figure 1:
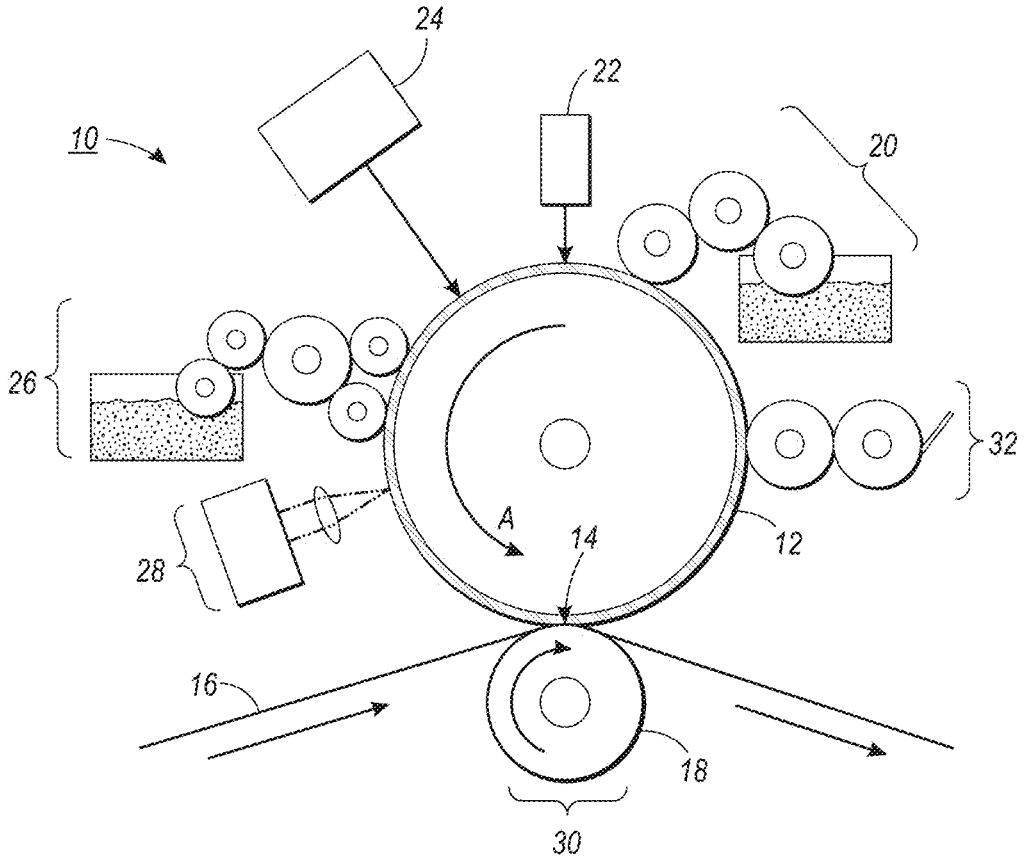
FIG. 1 RELATED ART
FIG. 1 is a side view of a related art variable data lithography system.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of resistors" may include two or more resistors.

The term "silicone" is well understood to those of skill in the relevant art and refers to polyorganosiloxanes having a backbone formed from silicon and oxygen atoms and sidechains containing carbon and hydrogen atoms. For the purposes of this application, the term "silicone" should also be understood to exclude siloxanes that contain fluorine atoms, while the term "fluorosilicone" is used to cover the class of siloxanes that contain fluorine atoms. Other atoms may be present in the silicone rubber, for example nitrogen atoms in amine groups which are used to link siloxane chains together during crosslinking.

The term "fluorosilicone" as used herein refers to polyorganosiloxanes having a backbone formed from silicon and oxygen atoms, and sidechains containing carbon, hydrogen, and fluorine atoms. At least one fluorine atom is present in the sidechain. The sidechains can be linear, branched, cyclic, or aromatic. The fluorosilicone may also contain functional groups, such as amino groups, which permit addition crosslinking. When the crosslinking is complete, such groups become part of the backbone of the overall fluorosilicone. The side chains of the polyorganosiloxane can also be alkyl or aryl. Fluorosilicones are commercially available, for example CFl-3510 from NuSil or SLM (n-27) from Wacker.

The terms "print media", "print substrate" and "print sheet" generally refers to a usually flexible physical sheet of paper, polymer, Mylar material, plastic, or other suitable physical print media substrate, sheets, webs, etc., for images, whether precut or web fed.

The term "printing device" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

As used herein, an "electromagnetic receptor" or "electromagnetic absorbent" is a material which will interact with electromagnetic energy to dissipate the energy such as heat. The applied electromagnetic energy could be used to trigger thermal losses at the receptor through a combination of loss mechanisms.

All physical properties that are defined hereinafter are measured at 20° to 25° C. unless otherwise specified. The term "room temperature" refers to 25° C. unless otherwise specified.

When referring to any numerical range of values herein, such ranges, are understood to include each and every number and/or fraction between the stated range minimum and maximum. For example, a range of 0.5-6% would expressly include all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

While the fluorosilicone composition is discussed herein in relation to ink-based digital offset printing or variable data lithographic printing systems, embodiments of the fluorosilicone composition, or methods of manufacturing imaging members using the same, may be used for other applications, including printing applications other than ink based digital offset printing or variable data lithographic printing systems.

Many of the examples mentioned herein are directed to an imaging blanket (including, for example, a printing sleeve, belt, drum, and the like) that has a uniformly grained and textured blanket surface that is ink-patterned for printing. In a still further example of variable data lithographic printing, such as disclosed in the '212 Publication, a direct central impression printing drum having a low durometer polymer imaging blanket is employed, over which for example, a latent image may be formed and inked. Such a polymer imaging blanket requires, among other parameters, a unique specification of surface roughness, radiation absorptivity, and oleophobicity.

FIG. 1 depicts a related art variable data lithography printing system 10 as disclosed in the '212 Publication. A general description of the exemplary system 10 shown in FIG. 1 is provided here. Additional details regarding individual components and/or subsystems shown in the exemplary system 10 of FIG. 1 may be found in the '212 Publication. As shown in FIG. 1, the exemplary system 10 may include an imaging member 12 used to apply an inked image to a target image receiving media substrate 16 at a transfer nip 14. The transfer nip 14 is produced by an impression roller 18, as part of an image transfer mechanism 30, exerting pressure in the direction of the imaging member 12.

The exemplary system 10 may be used for producing images on a wide variety of image receiving media substrates 16. The '212 Publication explains the wide latitude of marking (printing) materials that may be used, including marking materials with pigment densities greater than 10% by weight. Increasing densities of the pigment materials suspended in solution to produce different color inks is generally understood to result in increased image quality and vibrancy. These increased densities, however, often result in precluding the use of such inks in certain image forming applications that are conventionally used to facilitate variable data digital image forming, including, for example, jetted ink image forming applications.

As noted above, the imaging member 12 may be comprised of a reimageable surface layer or plate formed over a structural mounting layer that may be, for example, a cylindrical core, or one or more structural layers over a cylindrical core. A fountain solution subsystem 20 may be provided generally comprising a series of rollers, which may be considered as dampening rollers or a dampening unit, for uniformly wetting the reimageable plate surface with a layer of dampening fluid or fountain solution, generally having a uniform thickness, to the reimageable plate surface of the imaging member 12. Once the dampening fluid or fountain solution is metered onto the reimageable surface, a thickness of the layer of dampening fluid or fountain solution may be measured using a sensor 22 that provides feedback to control the metering of the dampening fluid or fountain solution onto the reimageable plate surface.

An optical patterning subsystem 24 may be used to selectively form a latent image in the uniform fountain solution layer by image-wise patterning the fountain solution layer using, for example, laser energy. It is advantageous to form the reimageable plate surface of the imaging member 12 from materials that should ideally absorb most of the IR or laser energy emitted from the optical patterning subsystem 24 close to the reimageable plate surface. Forming the plate surface of such materials may advantageously aid in substantially minimizing energy wasted in heating the fountain solution and coincidentally minimizing lateral spreading of heat in order to maintain a high spatial resolution capability. The mechanics at work in the patterning process undertaken by the optical patterning subsystem 24 of the exemplary system 10 are described in detail with reference to FIG. 5 in the '212 Publication. Briefly, the application of optical patterning energy from the optical patterning subsystem 24 results in selective evaporation of portions of the uniform layer of fountain solution in a manner that produces a latent image.

The patterned layer of fountain solution having a latent image over the reimageable plate surface of the imaging member 12 is then presented or introduced to an inker subsystem 26. The inker subsystem 26 is usable to apply a uniform layer of ink over the patterned layer of fountain solution and the reimageable plate surface of the imaging member 12. In embodiments, the inker subsystem 26 may use an anilox roller to meter an ink onto one or more ink forming rollers that are in contact with the reimageable plate surface of the imaging member 12. In other embodiments, the inker subsystem 26 may include other traditional elements such as a series of metering rollers to provide a precise feed rate of ink to the reimageable plate surface. The inker subsystem 26 may deposit the ink to the areas representing the imaged portions of the reimageable plate surface, while ink deposited on the non-imaged portions of the fountain solution layer will not adhere to those portions.

Cohesiveness and viscosity of the ink residing on the reimageable plate surface may be modified by a number of mechanisms, including through the use of some manner of rheology control subsystem 28. In embodiments, the rheology control subsystem 28 may form a partial crosslinking core of the ink on the reimageable plate surface to, for example, increase ink cohesive strength relative to an adhesive strength of the ink to the reimageable plate surface. In embodiments, certain curing mechanisms may be employed. These curing mechanisms may include, for example, optical or photo curing, heat curing, drying, or various forms of chemical curing. Cooling may be used to modify rheology of the transferred ink as well via multiple physical, mechanical or chemical cooling mechanisms.

Substrate marking occurs as the ink is transferred from the reimageable plate surface to a substrate of image receiving media 16 using the transfer subsystem 30. With the adhesion and/or cohesion of the ink having been modified by the rheology control system 28, modified adhesion and/or cohesion of the ink causes the ink to transfer substantially completely preferentially adhering to the substrate 16 as it separates from the reimageable plate surface of the imaging member 12 at the transfer nip 14. Careful control of the temperature and pressure conditions at the transfer nip 14, combined with reality adjustment of the ink, may allow transfer efficiencies for the ink from the reimageable plate surface of the imaging member 12 to the substrate 16 to exceed 95%. While it is possible that some fountain solution may also wet substrate 16, the volume of such transferred fountain solution will generally be minimal so as to rapidly evaporate or otherwise be absorbed by the substrate 16.

Finally, a cleaning system 32 is provided to remove residual products, including non-transferred residual ink and/or remaining fountain solution from the reimageable plate surface in a manner that is intended to prepare and condition the reimageable plate surface of the imaging member 12 to repeat the above cycle for image transfer in a variable digital data image forming operations in the exemplary system 10. An air knife may be employed to remove residual fountain solution. It is anticipated, however, that some amount of ink residue may remain. Removal of such remaining ink residue may be accomplished through use by some form of cleaning subsystem 32. The '212 Publication describes details of such a cleaning subsystem 32 including at least a first cleaning member such as a sticky or tacky member in physical contact with the reimageable surface of the imaging member 12, the sticky or tacky member removing residual ink and any remaining small amounts of surfactant compounds from the fountain solution of the reimageable surface of the imaging member 12. The sticky or tacky member may then be brought into contact with a smooth roller to which residual ink may be transferred from the sticky or tacky member, the ink being subsequently stripped from the smooth roller by, for example, a doctor blade.

The '212 Publication details other mechanisms by which cleaning of the reimageable surface of the imaging member 12 may be facilitated. Regardless of the cleaning mechanism, however, cleaning of the residual ink and fountain solution from the reimageable surface of the imaging member 12 is essential to prevent a residual image from being printed in the proposed system. Once cleaned, the reimageable surface of the imaging member 12 is again presented to the fountain solution subsystem 20 by which a fresh layer of fountain solution is supplied to the reimageable surface of the imaging member 12, and the process is repeated.

The imaging member 12 plays multiple roles in the variable data lithography printing process, which include: (a) deposition of the fountain solution, (b) creation of the latent image, (c) printing of the ink, and (d) transfer of the ink to the receiving substrate or media. Some desirable qualities for the imaging member 12, particularly its surface, include high tensile strength to increase the useful service lifetime of the imaging member. In some embodiments, the surface layer should also weakly adhere to the ink, yet be wettable with the ink, to promote both uniform inking of image areas and to promote subsequent transfer of the ink from the surface to the receiving substrate. Finally, some solvents have such a low molecular weight that they inevitably cause some swelling of imaging member surface layers. Wear can proceed indirectly under these swell conditions by causing the release of near infrared laser energy absorbing particles at the imaging member surface, which then act as abrasive particles. Accordingly, in some embodiments, the imaging member surface layer has a low tendency to be penetrated by solvent.

In some embodiments, the surface layer may have a thickness of about 10 microns (μm) to about 1 millimeter (mm), depending on the requirements of the overall printing system. In other embodiments, the surface layer has a thickness of about 20 μm to about 100 μm. In one embodiment, the thickness of the surface layer is of about 40 μm to about 60 μm.

In some embodiments, the surface layer may have a surface energy of 22 dynes/cm or less with a polar component of 5 dynes/cm or less. In other embodiments, the surface layer has a surface tension of 21 dynes/cm or less with a polar component of 2 dynes/cm or less or a surface tension of 19 dynes/cm or less with a polar component of 1 dyne/cm or less.

Figure 2:
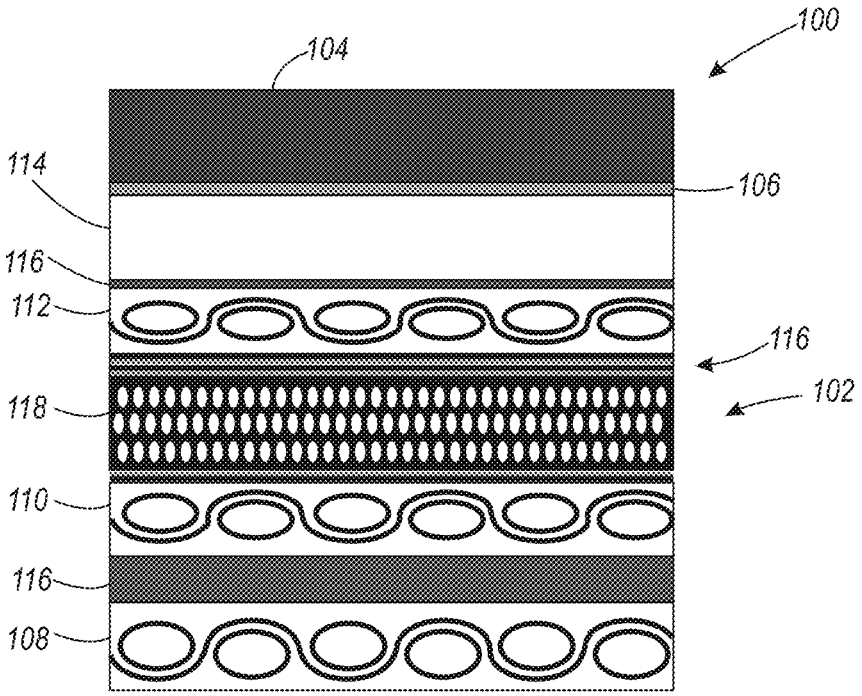
FIG. 2 is a side diagrammatical view of a multilayer imaging blanket in accordance with an exemplary embodiment.

FIG. 2 depicts an imaging blanket for a variable data lithography printing system. The imaging blanket is a multilayer blanket 100 having a base 102, a surface layer 104 and a primer layer 106 there between. The base 102 is a carcass at the interior of the imaging blanket intentionally designed to support the surface (e.g., topcoat) layer. The carcass may be Sulphur free, even though the surface layer is not limited to a specific carcass. The surface layer 104 may include fluorosilicone coated about the base, with the fluorosilicone surface layer being platinum catalyzed and including carbon black, a silica, a crosslinker, and a solvent. The primer layer 106 between the base 102 and the surface layer is intentionally designed to improve adhesion between the base and the surface layer.

The base 102 may be a multilayer carcass including a bottom fabric layer 108, a center fabric layer 110 about the bottom fabric layer, a top fabric layer 112 about the center fabric layer, and a top rubber surface 114 above the top fabric layer. The top rubber surface 114 may be Sulphur free, which may be understood to include less than 0.3% Sulphur, and may be understood to include no Sulphur. In addition, the multilayer carcass of the base 102 may include binding layers 116 on opposite sides of the center fabric layer 110, with one of the binding layers coupling the bottom fabric layer 108 and the center fabric layer, and the second one of the binding layers coupling the center fabric layer and the top fabric layer 112. One or both binding layers 116 may include a compressible rubber layer 118.

The bottom fabric layer 108 may be a woven fabric (e.g., cotton, cotton and polyester, polyester) with a lower contacting surface configured to contact directly or indirectly a printing cylinder (not shown) when the multilayer imaging blanket is wrapped around the printing cylinder. The center fabric layer 110 may also be a woven fabric like the bottom fabric layer 108. Both the center and bottom fabric layers may have a substance value in a range between 150-250 gr/m$^2$. The top fabric layer 112 may be made of polyester, polyethylene, polyamide, fiberglass, polypropylene, vinyl, polyphenylene, sulphide, aramids, cotton fiber or any combination thereof, preferably with a thickness value of 35-45 mm and a substance value of 80-90 gr/m$^2$.

Each of the binding layers 116 includes an adhesive layer adjacent at least one of the fabric layers 108, 110, 112, that may be made of a polymeric adhesive rubber preferably based on nitrile butadiene rubber. The compressible rubber layer 118 may be made of a polymeric foam preferably with nitrile butadiene rubber modified by adding an expansion agent.

Prior to the application of surface layer 104 on the top rubber surface 114 of the base 102, the primer layer 106 is applied to the top rubber surface to improve interlayer adhesion between the base and the surface layer. An example of the primer in the primer layer is a siloxane based primer with the main component being octamethyl trisiloxane (e.g., S11 NC commercially available from Henkel). In addition an inline corona treatment can be applied to the base 102 and/or primer layer 106 for further improved adhesion, as readily understood by a skilled artisan. Such inline corona treatments may increase the surface energy and adhesion of the imaging blanket layers.

Some embodiments contemplate methods of manufacturing the imaging member surface layer 104. For example, in one embodiment, the method includes depositing a fluorosilicone surface layer composition upon a multilayer base by flow coating, ribbon coating or dip coating; and curing the surface layer at an elevated temperature. In other examples, the fluoroelastomer surface layer may further comprise a catalyst, such as a platinum catalyst, and a crosslinker. In one embodiment, the fluoroelastomer surface layer is flow coated unto the base and primer layers 102, 106 through one or more nozzles, platinum catalyzed and post-cured at an elevated temperature, for example, of 160° C. For example, the fluoroelastomer surface layer composition may be deposited on the base and primer layers at a spindle speed between 5 and 300 RPM, with a coating head traverse rate between 2 to 60 mm/min, a coat dispensing rate from 6 to 40 grams/min, and at a relative humidity at 25° C. between 40 to 65%.

The curing may be performed at an elevated temperature of from about 140° C. to about 180° C. This elevated temperature is in contrast to room temperature. The curing may occur for a time period of from about 2 to 6 hours. In some embodiments, the curing time period is between 3 to 5 hours. In one embodiment, the curing time period is about 4 hours.

As described above, the surface layer 104 may include a fluoroelastomer composition. In one embodiment, the formulation for the fluoroelastomer composition includes a fluorosilicone, an infrared-absorbing filler, and silica. In other embodiments, the fluoroelastomer composition may further include a catalyst, such as a platinum catalyst, and a crosslinker, such as methylhydrosiloxane-trifluoropropylmethylsiloxane, an XL-150 crosslinker, commercially available from NuSil, or methyl hydrosiloxane-trifluoropropylmethyl siloxane commercially available from Wacker (SLM 50336).

In the examples, the infrared-absorbing filler may be carbon black, a metal oxide such as iron oxide (FeO), carbon nanotubes, graphene, graphite, or carbon fibers. The filler may have an average particle size of from about 2 nanometers (nm) to about 10 μm. In one example, the filler may have an average particle size of from about 20 nm to about 5 μm. In another embodiment, the filler has an average particle size of about 100 nm. Preferably, the infrared-absorbing filler is carbon black. In another example, the infrared-absorbing filler is a low-sulphur carbon black, such as Emperor 1600 (available from Cabot). In one embodiment, a sulphur content of the carbon black is 0.3% or less. In another embodiment, the sulphur content of the carbon black is 0.15% or less.

In examples, the fluoroelastomer composition may include between 5% and 30% by weight infrared-absorbing filler based on the total weight of the fluoroelastomer composition. In an example, the fluoroelastomer includes between 15% and 35% by weight infrared-absorbing filler. In yet another example, the fluoroelastomer includes about 20% by weight infrared-absorbing filler based on the total weight of the fluoroelastomer composition.

In one embodiment, the fluoroelastomer composition includes silica. For example, in one embodiment, the fluoroelastomer composition includes between 1% and 5% by weight silica based on the total weight of the fluoroelastomer composition. In another embodiment, the fluoroelastomer includes between 1% and 4% by weight silica. In yet another embodiment, the fluoroelastomer includes about 1.15% by weight silica based on the total weight of the fluoroelastomer composition. The silica may have an average particle size of from about 10 nm to about 0.2 μm. In one embodiment, the silica may have an average particle size of from about 50 nm to about 0.1 μm. In another embodiment, the silica has an average particle size of about 20 nm.

In examples, the fluoroelastomer composition includes a catalyst. In one embodiment, the catalyst is a platinum (Pt) catalyst, for example a 14.3% Platinum in butyl acetate or in trfluorotoluene. In one example, the fluoroelastomer composition includes between 0.15% and 0.35% by weight of a catalyst based on the total weight of the fluoroelastomer composition. In another embodiment, the fluoroelastomer includes between 0.2% and 0.30% by weight catalyst. In yet another example, the fluoroelastomer includes about 0.25% by weight catalyst based on the total weight of the fluoroelastomer composition.

In one embodiment, the fluoroelastomer composition includes a crosslinker (e.g., vinyl terminated trifluoropropyl methylsiloxane). In some embodiments, the fluoroelastomer composition includes fluorosilicone crosslinker. In one embodiment, the crosslinker is a XL-150 crosslinker from NuSil Corporation. In one embodiment, the crosslinker is a SLM 50336 crosslinker from Wacker. For example, in one embodiment, the fluoroelastomer composition includes between 10% and 28% by weight of a crosslinker based on the total weight of the fluoroelastomer composition. In another embodiment, the fluoroelastomer includes between 12% and 20% by weight crosslinker. In yet another embodiment, the fluoroelastomer includes about 15% by weight crosslinker based on the total weight of the fluoroelastomer composition.

In examples of the embodiments, the fluorosilicone surface layer has a first part and a second part. While not being limited to a particular theory, the first part may include SLM, carbon black, silica and butyl acetate, and the second part may include a platinum catalyst, a Wacker crosslinker, butyl acetate and an inhibitor. In another example, the first part may include a vinyl terminated trifluoropropyl methylsiloxane polymer (e.g., Wacker 50330, SML (n=27)), carbon black (e.g., low-sulphur carbon black), silica and butyl acetate, and the second part may include a platinum catalyst, a crosslinker (e.g., methyl hydro siloxane trifluoropropyl methylsiloxane (XL-150 or Wacker SLM 50336)), a dispersion stabilizer (e.g., polyoxyalkyleneamine derivative), and an inhibitor (e.g., Wacker Pt88). In another example, the fluorosilicone surface layer may have viscosity adjusted to about 90-110 cP, with the first part including 55-65 grams (g) of a vinyl terminated trifluoropropyl methylsiloxane polymer (e.g., SML (n=27)), 16-20 g of carbon black (e.g., low-sulphur carbon black), 0.95-1.15 g of the silica and 160-200 g of butyl acetate, and the second part may include 2.5-3.5 ml of the platinum catalyst (e.g., about 14.3% in Butyl Acetate), 26-29 g of a crosslinker (e.g., methyl hydro siloxane trifluoropropyl methylsiloxane), 26-29 g of butyl acetate, a polyoxyalkyleneamine derivative as a dispersion stabilizer, and 400-500 μl of an inhibitor.

Figure 3:
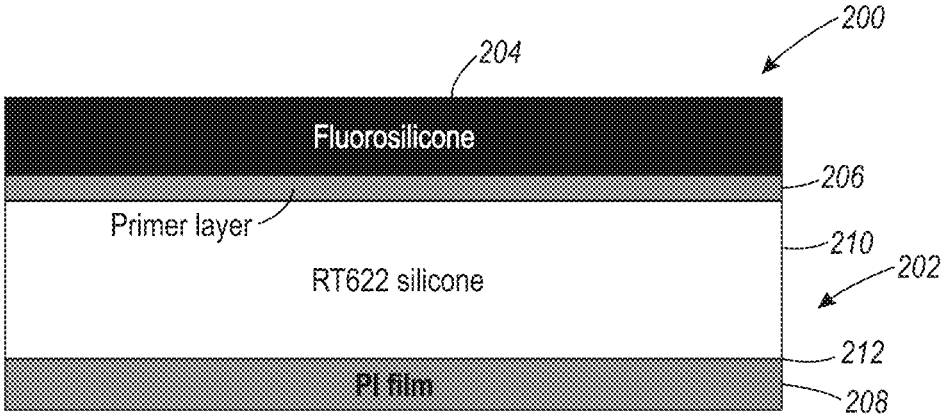
FIG. 3 is a side diagrammatical view of a multilayer imaging blanket in accordance with another exemplary embodiment.

FIG. 3 depicts another exemplary imaging blanket for a variable data lithography printing system. The imaging blanket is a multilayer blanket 200 having a base 202, a surface layer 204 and a primer layer 206 there between. The base 202 includes a seamless polyimide film 208 coated with a platinum cured silicone 210 (e.g., RT622 silicone, platinum cured siloxane, platinum cured fluorosilicone) at the interior of the imaging blanket as a multilayer carcass intentionally designed to support the surface (e.g., topcoat)

layer. In this configuration, the polyimide film 208 provides support for the platinum cured silicone 210, and the platinum cured silicone provides the desired conformance to the printing surface of the surface layer 204. The platinum cured silicone or fluorosilicone has advantages for pot life, better control over cure kinetics, coating and durability due to better crosslinking. Without platinum curing, the silicone or fluorosilicone layer would start curing during coating.

The polyimide film 208 is a 20-80 μm thick seamless polyimide (PI) film that may be mounted on a mandrel. To further ensure a coupling of the PI film and the platinum cured silicone 210, a thin layer of primer 212 (e.g., vinyl terminated alkoxysilane, Wacker G790 primer) may be applied on the surface of the PI film using, for example, a brush or other coating applicator. While not being limited to a particular theory, the primer 212 may be applied for 1-2 hours at room temperature and 40-60% humidity. No pretreatment of PI film and no wiping of primer excess are required.

The platinum-cured silicone 210 may be a platinum cured siloxane having 8-10 mass parts of platinum cured siloxane to 1 part of crosslinker (premixed with platinum-catalyst and iron oxide particles), and 4-5 parts of a solvent (e.g., methyl isobutyl ketone (MIBK)), with a final viscosity of about 15000-20000 cPs. While not being limited to a particular theory, the platinum-cured silicone is applied, for example, flow coated on the surface of the PI film 208 functionalized with the primer 212.

Similar to the top rubber surface 114, the platinum-cured silicone 210 can be either treated with a primer (e.g., S11 commercially available from Henkel) and/or have an inline corona treatment that helps improve the adhesion of the fluorosilicone to the platinum-cured silicone surface. In examples, the formulation of the catalyzed fluorosilicone surface layer 210 may include a first part and a second part as discussed above. In other words, the first part may include SLM, carbon black, silica and butyl acetate, and the second part may include a platinum catalyst, a Wacker crosslinker, butyl acetate and an inhibitor. In an example, the first part may include a vinyl terminated trifluoropropyl methylsiloxane polymer (e.g., Wacker 50330, SML (n=27)), carbon black (e.g., low-sulphur carbon black), silica and butyl acetate, and the second part may include a platinum catalyst, a crosslinker (e.g., methyl hydro siloxane trifluoropropyl methylsiloxane (XL-150 or Wacker SLM 50336)), a butyl acetate, a dispersion stabilizer, and an inhibitor (e.g., Wacker Pt88). In another example, the fluorosilicone surface layer may have viscosity adjusted to about 90-110 cP, with the first part including 55-65 g of a vinyl terminated trifluoropropyl methylsiloxane polymer (e.g., SML (n=27)), 16-20 g of carbon black (e.g., low-sulphur carbon black), 0.95-1.15 g of the silica and 160-200 g of butyl acetate, and the second part may include 2.5-3.5 ml of the platinum catalyst (e.g., about 14.3% in Butyl Acetate), 26-29 g of a crosslinker (e.g., methyl hydro siloxane trifluoropropyl methylsiloxane), 26-29 g butyl acetate, a polyoxyalkyleneamine derivative as a dispersion stabilizer, and 400-500 μl of an inhibitor. In yet another example, the formulation of the catalyzed fluorosilicone surface layer 210 may include 4-6 mass parts of fluorosilicone, about 1 part of a crosslinker (e.g., methylhydrosiloxane-trifluoropropyl methylsiloxane, XL-150 commercially available from NuSil, SLM 50336 commercially available from Wacker), 11-14 parts of trifluorotoluene (TFT), carbon black (e.g., 20% low-Sulphur carbon black), Fumed Silica (e.g., about 1.2-1.3%), a platinum-catalyst (e.g., about 4.2 ml per 100 g of fluorosilicone, 14.3% in TFT) with a viscosity of about 240-260 cP. Preferably the flow coated surface layer 204 may be post cured for about 3-5 hours at 150-170° C.

Aspects of the present disclosure may be further understood by referring to the following examples. The examples are illustrative, and are not intended to be limiting embodiments thereof. Example 1 illustrates the process of making a fluoroelastomer according to one embodiment of the present disclosure.

Example 1

An exemplary formulation of the fluorosilicone surface layer with 20% CB is as follows:

Part A
SLM (n=27) fluorosilicone—60 g
Carbon Black (20%)—18 g
Silica(1.15%)—1.05 g
Butyl Acetate—180 g
Stainless Steel Beads—105 g
Part B
Platinum (Pt) catalyst (14.3% in Butyl Acetate)—3000 μl
Wacker crosslinker—27.42 g
Butyl Acetate—27.42 g
Pt 88 catalyst inhibitor—450 μl
Viscosity: adjusted to 100 cP Part A of the formulation was prepared with two-step shaking. First, Silica was placed in the vacuum oven being vacuumed at 100° C. for 2 hours whereas carbon black was used directly without any treatment. Then, 1.05 g of silica and 18 g of carbon black were mixed with 180 g of butyl acetate and 105 g of stainless steel beads in a polypropylene bottle followed by shaking in a paint-shaker for 3 hours. After the shaking was done, 60 g of SLM was added into the dispersion followed by the other 4 hour shaking.

SML (n=27) fluorosilicone is illustrated in Formula 1 below.

Formula 1

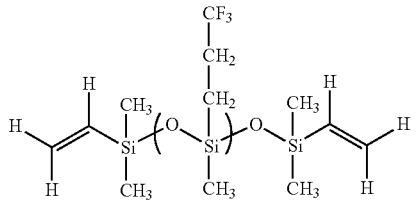

As noted above, Part B of the formulation of the fluorosilicone surface layer includes a platinum catalyst (14.3% in butyl acetate) and crosslinker solution. The crosslinker solution was prepared by addition of 27.42 g of vinyl terminated trifluoropropyl methylsiloxane polymer Wacker crosslinker, 27.42 g of butyl acetate and 450 μl of the catalyst inhibitor Pt 88 altogether in a polypropylene bottle. The solution underwent an ultrasonic bath for 30 minutes. Platinum (14.3% in butyl acetate) was prepared by addition of 429 μl of platinum catalyst into the polypropylene bottle with 2571 μl of butyl acetate. It should be noted that the catalyst inhibitor Pt88 may be used in the solution to increase the pot life of the solution for flow coating. The extractable studies provided by the inventors show that addition of Pt88 does not affect the curing process but only increases the pot life.

The Platinum (Pt) catalyst is illustrated in Formula 2 below.

Formula 2

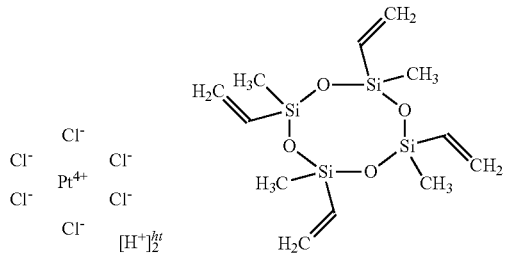

The Wacker crosslinker is illustrated in Formula 3 below.

Formula 3

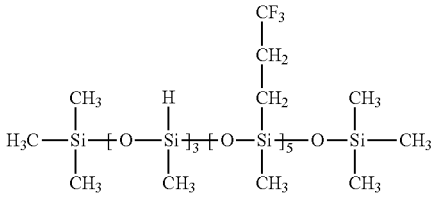

The crosslinking mechanism is illustrated in Formula 4 below.

Formula 4

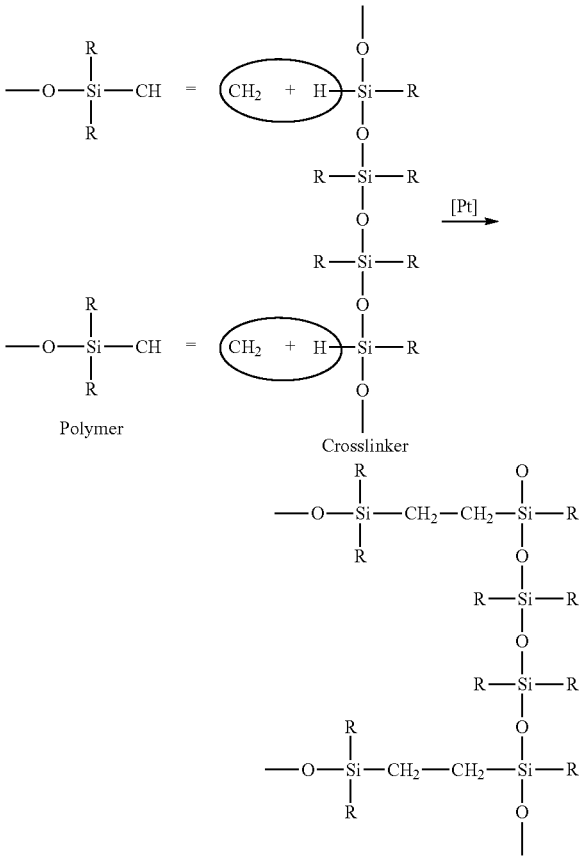

Mechanism of Crosslinking

R═—CH3 or —CH2-CH2-CF3

When the shaking process for Part A was completed, the platinum 14.3% was added in the solution of Part A followed by 5 min of gentle shaking. Then the crosslinker was added in the modified Part A solution followed by 5 min of ball milling. The total solid content was controlled by dilution with additional amount of butyl acetate. The dispersion was filtered to remove the stainless steel beads, followed by degassing of the filtered dispersion. The dispersion was then coated over the multilayer base and primer layer. The dispersion could also be molded. The coated platinum catalyzed fluorosilicone surface layer was heated at 160° C. for 4 hour to finish curing of the multilayer imaging blanket. The extractable of the resulting fluorosilicone films were less than 5%, similar to the fluorosilicone produced from the TFT formulation of Example 2 below.

Example 2

In this example, the fluorosilicone topcoat is coated on the top of a seamless polyimide coated with a platinum cured silicone. A 20-80 μm thick seamless polyimide (PI) film is mounted on a mandrel. A thin layer of Wacker G790 primer (vinyl terminated alkoxysilane) is applied on the surface of the PI film using a brush. No pretreatment of PI film and no wiping of primer excess are required. The primer is applied for 1-2 h at room temperature and 40-60% humidity.

The formulation of the platinum-cured RT622 silicone composition is flow coated on the surface of PI film functionalized with the primer. The silicone composition includes 9 mass parts of RT622 to 1 part of crosslinker (premixed with platinum-catalyst and iron oxide particles), and 4.5 parts of methyl isobutyl ketone (MIBK). The final viscosity is around 15000-20000 cPs.

The RT622 silicone composition surface can be either treated with a primer (e.g., S11 from Henkel) and/or have an inline corona treatment that helps improve the adhesion of the fluorosilicone to the underlayer RT 622 silicone surface. The fluorosilicone surface layer is then flow coated on the surface of the RT 622 silicone functionalized with the primer and/or corona treatment. The formulation of the topcoat fluorosilicone surface layer has two parts, with the first part including 55-65 g of a vinyl terminated trifluoropropyl methylsiloxane polymer, 16-20 g of low-sulphur carbon black, 0.95-1.15 g of silica and 160-200 g of butyl acetate, and the second part including 2.5-3.5 ml of the platinum catalyst (about 14.3% in Butyl Acetate), 26-29 g of a methyl hydro siloxane trifluoropropyl methylsiloxane crosslinker, 26-29 g of butyl acetate, a polyoxyalkyleneamine derivative as a dispersion stabilizer, and 400-500 μl of an inhibitor.

While examples of the surface layer include Trifluorotoluene (TFT) as a solvent, the inventors note that TFT may not be most preferred as it is not an environmentally friendly solvent and therefore is not manufacture friendly. In this regards, the butyl acetate solvent discussed herein may provide a preferred example of the invention. In addition, SLM 50336 may be a preferred crosslinker to XL-150 because of their relative costs and availability.

Although the above description may contain specific details, they should not be construed as limiting the claims in any way. Other configurations of the described embodiments of the disclosed systems and methods are part of the scope of this disclosure. For example, the principles of the disclosure may be applied to each individual print station of a plurality of print stations where individual variable data lithography system or groups of the variable data lithography system have associated with them device management applications for communication with a plurality of users or print job ordering sources. Each print station may include some portion of the disclosed variable data lithography system and execute some portion of the disclosed method but not necessarily all of the system components or method steps.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A multilayer imaging blanket for a variable data lithography printing system, comprising:

a multilayer base having a lower contacting surface configured to wrap around a printing cylinder of the variable data lithography printing system;

a platinum catalyzed fluorosilicone surface layer coated about the multilayer base, the fluorosilicone surface layer including carbon black, a silica, a crosslinker, and a solvent; and a primer layer between the multilayer base and the fluorosilicone surface layer for improving interlayer adhesion between the multilayer base and the fluorosilicone surface layer, wherein the multilayer base is a Sulphur free carcass including a plurality of fabric layers including a top layer and a lower layer, a binding layer between the top fabric layer and the lower fabric layer and coupling the fabric layers together, and a Sulphur free rubber layer attached to the top fabric layer opposite the binding layer, the fluorosilicone surface layer including a first part and a second part in combination, the first part having a vinyl terminated trifluoropropyl methylsiloxane, a low-Sulphur carbon black as the carbon black, and the silica, the second part having a platinum catalyst, a methyl hydrosiloxanetrifluoropropyl methylsiloxane as the crosslinker, a polyoxyalkyleneamine derivative as a dispersion stabilizer, and an inhibitor.

2. The multilayer imaging blanket of claim 1, wherein the Sulphur-free rubber layer is carbon black free.

3. The multilayer imaging blanket of claim 1, the first part having 55-65 g of the vinyl terminated trifluoropropyl methylsiloxane, 16-20 g of the low-sulphur carbon black as the carbon black, and 0.95-1.15 g of the silica, the second part having 2.5-3.5 ml of the platinum catalyst, 26-29 g of the methyl hydrosiloxanetrifluoropropyl methylsiloxane and 400-500 μl of the inhibitor.

4. The multilayer imaging blanket of claim 1, wherein the top fabric layer of the multilayer base is corona treated for adhesion to the Sulphur free rubber layer.

5. A variable data lithography system, comprising:

a multilayer imaging blanket including:

a multilayer base having a lower contacting surface configured to wrap around a printing cylinder of the variable data lithography printing system, a platinum catalyzed fluorosilicone surface layer coated about the multilayer base, the fluorosilicone surface layer including carbon black, a silica, a crosslinker, and a solvent, and a primer layer between the multilayer base and the fluorosilicone surface layer for improving interlayer adhesion between the multilayer base and the fluorosilicone surface layer;

a fountain solution subsystem configured for applying a layer of fountain solution to the multilayer imaging blanket;

a patterning subsystem configured for selectively removing portions of the fountain solution layer so as to produce a latent image in the fountain solution;

an inking subsystem configured for applying ink over the imaging blanket such that said ink selectively occupies regions of the imaging blanket where fountain solution was removed by the patterning subsystem to thereby produce an inked latent image; and an image transfer subsystem configured for transferring the inked latent image to a substrate, the platinum catalyzed fluorosilicone surface layer including a first part and a second part in combination, the first part having a vinyl terminated trifluoropropyl methylsiloxane, a low-Sulphur carbon black as the carbon black, and the silica, the second part having a platinum catalyst, a methyl hydrosiloxanetrifluoropropyl methylsiloxane as the crosslinker, a polyoxyalkyleneamine derivative as a dispersion stabilizer, and an inhibitor.

6. The variable data lithography system of claim 5, the first part having 55-65 g of the vinyl terminated trifluoropropyl methylsiloxane, 16-20 g of the low-sulphur carbon black, and 0.95-1.15 g of the silica, the second part having 2.5-3.5 ml of the platinum catalyst, 26-29 g of the methyl hydrosiloxanetrifluoropropyl methylsiloxane, and 400-500 μl of the inhibitor, and wherein the multilayer base is a Sulphur free carcass including a plurality of fabric layers including a top layer and a lower layer, a binding layer between the top fabric layer and the lower fabric layer and coupling the fabric layers together, and a sulphur-free rubber layer attached to the top fabric layer opposite the binding layer.

7. A method of manufacturing a multilayer imaging blanket for a variable data lithography printing system, comprising:

a platinum catalyzed fluorosilicone surface layer prepared from a mixture of a first part and a second part, the first part having a vinyl terminated trifluoropropyl methylsiloxane, a low-Sulphur carbon black as the carbon black, a silica, and a solvent;

the second part having a platinum catalyst, a methyl hydrosiloxanetrifluoropropyl methylsiloxane as the crosslinker a polyoxyalkyleneamine derivative as a dispersion stabilizer and an inhibitor;

applying a multilayer base composition into a mold structure, the multilayer base having a lower contacting surface configured to wrap around a printing cylinder of the variable data lithography printing system;

curing the platinum catalyzed fluorosilicone surface layer;

applying a primer layer over the multilayer base;

coating a platinum catalyzed fluorosilicone surface layer about the primer layer; the primer layer improving interlayer adhesion between the multilayer base and the fluorosilicone surface layer; wherein the multilayer base is a Sulphur free carcass includes a plurality of fabric layers including a top layer and a lower layer, a binding layer between the top fabric layer and the lower fabric layer and coupling the fabric layers together; and a Sulphur free rubber layer attached to the top fabric layer opposite the binding layer.

8. The method of claim 7, the step of applying a multi-layer base composition into a mold structure including forming a Sulphur-free layer surface atop the mold structure, the first part having 55-65 g of the vinyl terminated trifluoropropyl methylsiloxane, 16-20 g of the low-sulphur carbon black, and 0.95-1.15 g of the silica, the second part having 2.5-3.5 ml of the platinum catalyst, 26-29 g of the methyl hydrosiloxanetrifluoropropyl methylsiloxane, and 400-500 μl of the inhibitor.

9. The method of claim 7, the step of coating a fluorosilicone surface layer including coating by flow coating, ribbon coating or dip coating.

10. The method of claim 7, further comprising applying a corona treatment to the mold structure for adhesion to the platinum catalyzed fluorosilicone surface layer.

* * * * *